US010758768B2

(12) United States Patent
Meyer

(10) Patent No.: US 10,758,768 B2
(45) Date of Patent: Sep. 1, 2020

(54) ERGONOMIC STRENGTH CONDITIONING GRIP

(71) Applicant: Philip Berend Meyer, Surprise, AZ (US)

(72) Inventor: Philip Berend Meyer, Surprise, AZ (US)

( * ) Notice: Subject to any disclaimer, the term of this patent is extended or adjusted under 35 U.S.C. 154(b) by 0 days.

(21) Appl. No.: 16/554,882

(22) Filed: Aug. 29, 2019

(65) Prior Publication Data

US 2020/0047019 A1 Feb. 13, 2020

Related U.S. Application Data

(63) Continuation-in-part of application No. 16/053,691, filed on Aug. 2, 2018, now abandoned, which is a continuation-in-part of application No. 15/851,334, filed on Dec. 21, 2017, now abandoned.

(51) Int. Cl.

| | |
|---|---|
| ***A63B 21/02*** | (2006.01) |
| ***A63B 23/16*** | (2006.01) |
| ***A63B 21/00*** | (2006.01) |

(52) U.S. Cl.

CPC ..... *A63B 21/028* (2013.01); *A63B 21/151* (2013.01); *A63B 21/4035* (2015.10); *A63B 23/16* (2013.01); *A63B 2225/093* (2013.01)

(58) Field of Classification Search

CPC ..... A63B 21/4035; A63B 21/4037; A63B 21/4039; A63B 23/16; A63B 21/028; A63B 21/023; A61B 5/225; G05G 1/06; B25G 1/10; B25G 1/102; B25G 3/32; Y10T 16/476

See application file for complete search history.

(56) References Cited

U.S. PATENT DOCUMENTS

| | | | | | |
|---|---|---|---|---|---|
| 359,994 | A | * | 3/1887 | Brunner | A63B 21/075 482/108 |
| 2,056,054 | A | * | 9/1936 | Osgood | B25G 1/102 407/29.15 |
| D256,958 | S | * | 9/1980 | Markham | D30/160 |
| 5,350,342 | A | * | 9/1994 | Scatterday | |
| 5,865,146 | A | * | 2/1999 | Markham | A01K 15/026 119/707 |
| 5,904,118 | A | * | 5/1999 | Markham | A01K 15/025 119/707 |

(Continued)

*Primary Examiner* — Victor D Batson
*Assistant Examiner* — Matthew J Sullivan

(57) ABSTRACT

An ergonomic grip for strength conditioning has a grip body composed of three adjoined, progressively larger oblate spheroids. The major and minor diameters of the spheroids and their spacings combine to form invected surfaces at the junctions of first and second and second and third spheroids. These invected surfaces admit curved fingers of a grasping hand to provide a secure grip while eliminating a common problem of the little finger (4th finger) of the hand being crushed or discomforted. A central shaft passes through the grip body and includes an attachment affordance at one protruding end, and is coupled to a washer at the other end. A central cavity in the grip body allows the spheroids to compliantly conform to the inner concavities of an individual user's palm for increased comfort and positive grip. They eyebolt may also swivel to align itself to a connected cable during use.

16 Claims, 3 Drawing Sheets

(56) References Cited

U.S. PATENT DOCUMENTS

| | | | | |
|---|---|---|---|---|
| 6,439,166 | B1 * | 8/2002 | Markham | A01K 15/026 119/707 |
| 7,926,451 | B2 * | 4/2011 | Foster | |
| 7,959,541 | B2 * | 6/2011 | Jung | |
| 8,020,910 | B2 * | 9/2011 | Startzell | A45F 5/1026 294/170 |
| 8,118,747 | B2 * | 2/2012 | Furia et al. | |
| 8,276,547 | B2 * | 10/2012 | Markham | |
| 8,343,015 | B2 * | 1/2013 | Zachary | |
| 8,393,300 | B2 * | 3/2013 | Markham | A01K 15/026 119/709 |
| 9,421,683 | B2 * | 8/2016 | Savarino | A63B 21/023 |
| D805,207 | S * | 12/2017 | Ruflin | D24/187 |
| 2006/0173331 | A1 * | 8/2006 | Booton et al. | |
| 2012/0260463 | A1 * | 10/2012 | Hines | B25G 1/102 16/430 |
| 2014/0228183 | A1 * | 8/2014 | Falconi et al. | |
| 2014/0370473 | A1 * | 12/2014 | Williams | |
| 2017/0043205 | A1 * | 2/2017 | Wilson | |
| 2017/0173830 | A1 * | 6/2017 | Lewis | |
| 2017/0296860 | A1 * | 10/2017 | Watry | A63B 21/4035 |
| 2017/0326404 | A1 * | 11/2017 | Vardi | |
| 2017/0361159 | A1 * | 12/2017 | Malcolm | |
| 2018/0020817 | A1 * | 1/2018 | Wedlock | B25G 1/10 15/145 |

* cited by examiner

ERGONOMIC STRENGTH CONDITIONING GRIP

PRIORITY: CROSS-REFERENCE TO THE RELATED APPLICATION

This non-provisional utility patent application is a continuation in part of non-provisional utility patent Ser. No. 16/053,691 "Ergonomic Strength Conditioning Grip," filed Aug. 2, 2018 and currently pending.

Non-provisional patent application Ser. No. 16/053,691 "Ergonomic Strength Conditioning Grip," filed Aug. 2, 2018 is a continuation in part of U.S. utility application Ser. No. 15/851,334 "Ergonomic Strength Conditioning Grip," filed Dec. 21, 2017 and now abandoned.

The entire content of U.S. utility application Ser. No. 15/851,334 "Ergonomic Strength Conditioning Grip," filed Dec. 21, 2017 is hereby incorporated into this application document by reference. The entire content of U.S. utility application Ser. No. 16/053,691 "Ergonomic Strength Conditioning Grip," filed Aug. 2, 2018 is also hereby incorporated into this application document by reference.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD OF THE INVENTION

The invention relates to a hand grip for attaching to a rope, a cable, a chain, an eyelet, or the like, which resists pulling, so that a person may grab the grip comfortably and securely and exercise against tensile resistance.

BACKGROUND OF THE INVENTION

People who exercise for health and strength use a wide variety of equipment, and many popular machines offer a rope, a cord, a wire rope, a cable, a chain, or other flexible material or substantially linear assembly of linked components hereafter referred to as a "cable." Cables for exercise machines are commonly terminated with an eyelet, a swaged eye, a ring, a clevis, or other point of attachment.

People who want to exercise and condition their arms, upper body, and upper back may want to exercise against large forces, but they are often limited by the grip strength required for their hands to pass the larger forces in the cable along through their forearms and onto these larger muscle groups. Many people who try overall muscle conditioning regimens are discouraged by discomfort of the gripping tasks required of current and inferior products, and may give up before experiencing the pleasure and other benefits of a healthier and better conditioned body. Also, many other cable attachments tend to place a user's wrists and shoulders in an unnatural position which causes stress in those joints.

BRIEF SUMMARY OF THE INVENTION

The invention is an improved grip for the human hand for coupling to a cable of an exercise machine. With other available devices, grip strength is a preliminary requirement before exercising larger muscles of the upper body, shoulders and the back may be undertaken effectively. With these other devices, insufficient grip strength may be uncomfortable and a discouraging or insurmountable obstacle to people having less upper body strength. An improved hand grip may substantially bypass the grip strength requirement, provide comfort, and allow a wider variety of people to experience and achieve the benefits of upper body conditioning.

It is therefore a primary objective of the invention to provide a comfortable and ergonomic grip so even while applying modest grip strength, users may experience and achieve positive results from exercising groups of larger muscles of the upper arm, shoulders, and the back by lifting against forces which are less limited by grip strength. A corollary objective of this invention is to enable people having lesser grip strength to participate in and enjoy conditioning regimens which they would otherwise not enjoy or withstand with other grips and cable end hardware that are uncomfortable or painful to grasp for long periods of time.

Another objective of the invention is to provide a grip body or assembly which may be readily attached to and detached from various types of cable end hardware on exercise machines and attachment points on exercise weights. A corollary objective of the invention to offer a shape complementary to a typical configuration of fingers, thumb, and the shape of the palm of a hand so that compression forces within the body of the grip are applied to areas of the hand best able to withstand these forces without discomfort.

For cables made from wire rope, swaged end fittings often leave a short free end of wire rope protruding from a ferrule. Individual cable strand ends often terminate with sharp facets or burrs which may injure or create discomfort in a gripping hand. It is therefore another objective of the invention to eliminate the need for a gripping hand to come into contact with such uncomfortable or injurious strand ends.

Yet another objective of the invention is for it to be portable and convenient to carry around, so a user who exercises at several locations may easily bring one set of the inventive grip assemblies from one location to another. A corollary objective of the invention is for it to be easy to clean.

Various devices are currently available which attempt to address these challenges, although they may at best meet only one or two aspects of the totality of the requirements.

BRIEF DESCRIPTION OF THE DRAWINGS

A further understanding of the nature and advantages of particular embodiments may be realized by reference to the remaining portions of the specification and the drawings. Similar reference numerals are used to refer to similar components.

DETAILED DESCRIPTION OF CERTAIN EMBODIMENTS

Figure 1:
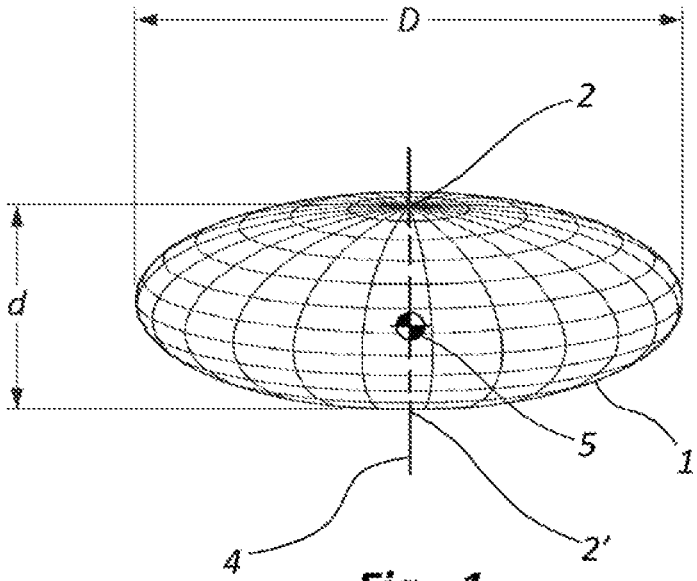
FIG. 1 shows an oblate spheroid and its polar axis.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this specification, the term "means for . . . " as used herein including the claims, is to be interpreted according to 35 USC 112 paragraph 6.

Unless otherwise indicated, all numbers herein used to express quantities, dimensions, and so forth, should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

In this specification any singular grammatical gender may subsume any other singular grammatical gender in all cases, and any plural grammatical gender may subsume any other plural grammatical gender in all cases. A user of the invention may be of any biological sex, thus all instances where "he," "his," or "him" are written may be replaced by "she," or "her," as appropriate, to equivalent meaning, effects, intents, and purposes. Also, grammatically irregular plural forms are recognized as their plain language equivalents, so that terms such as "at least one foot" are understood to be equivalent to "both feet" and other similar phrases of equivalent meaning.

Also in this specification, "weight" and "mass" and the plural forms of these words may be used interchangeably; e.g, masses are used for strength conditioning, but lifting a weight and lifting a mass achieve the same result in strength training. "Lifting" in this specification means any exercise consisting of moving or holding a human body part in position against a force developed by a weight or a friction force such as may be developed by a mechanical brake or a viscous damper. Many mechanisms are designed to generate forces which simulate weights being moved against gravity while the force actually developed by other means, such as pulling on springs or displacing a fluid by means of a piston. The term "lifting" in this specification will encompass all forms of exercising a human body against these weights or physical forces.

In this specification, a "cable" may mean a rope, a cord, a wire rope, a cable, a chain, or other flexible material or substantially linear assembly of linked components which are attached to a weight for lifting as an exercise. Also, for this specification the appendages of the hand are herein named, in linear order: the thumb, the first finger, the second finger, the third finger, and the little finger.

Shore A and Shore D durometer measurements are used in this specification to describe deformation behaviours of elastomeric, compliant, or other non-rigid materials used for the grip body of the invention. Testing of such materials and assignment or accordance of a Shore durometer rating figure on the "A" or "D" scales is an established practice within the manufacturing industry of parts like the grip body of the invention, and charts and other examples correlating many common objects made of deformable or compliant materials to their Shore durometer ratings are easily located on the internet and other industry reference publications.

Also within this specification, the word "collinear" for two or more spheroids each having a polar axis shall define an alignment in which all polar axes of all spheroids within a "collinear" set shall be contained within a cylindrical tolerance volume no larger than one-fifth (⅕) of a largest diameter of the largest spheroid which diameter is taken within five (5) degrees of its polar axis.

FIG. 1 shows an oblate spheroid. Within this specification, an oblate spheroid [1] defines as its polar axis [4] a line connecting the two points [2, 2'] on its surface which are furthest within and most distant from the smallest sphere which may circumscribe the entire volume of the spheroid. The major diameter 'D' of the oblate spheroid is equal to that of the circumscribing sphere. The major diameter lies on the equator of the spheroid. The minor diameter 'd' of an oblate spheroid is the distance between its poles [2, 2'] and the centroid [5] of the spheroid lies along its polar axis at a midpoint between its poles.

The invention is a new and improved grip which is an assembly of parts that together allow a user's hand to grasp an ergonomically shaped body and withstand and exercise against larger lifting forces without having to develop or maintain great grip strength.

Figure 2:
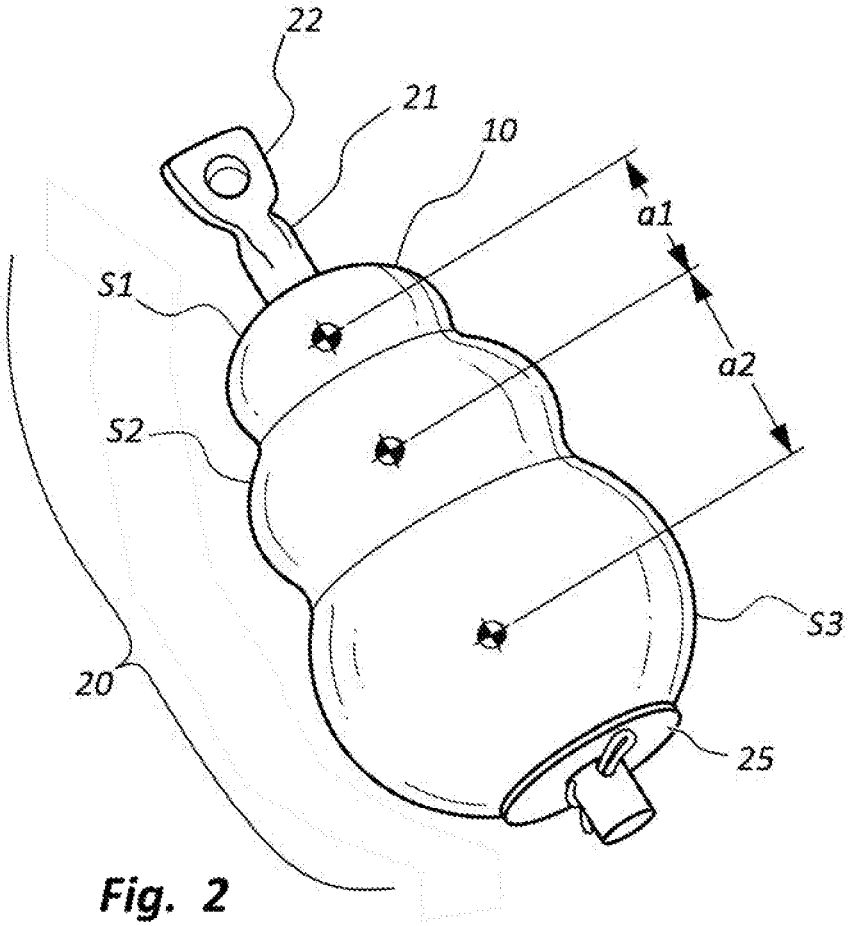
FIG. 2 shows an embodiment of a grip assembly in accordance with the invention.

FIG. 2 shows a grip assembly [20] in accordance with the invention. A shaft [21] has an attachment affordance [22] which in this embodiment is a widened, swaged area with a hole. This attachment affordance may be attached to many sorts of cable end fitting on exercise machines or on weights, such as hooks, split rings, spiral rings, chain links, and snap links. The shaft is disposed within a central aperture aligned with or close to the central axis of the grip body [10,] with its attachment affordance protruding beyond the grip body. A washer [25] is coupled to the shaft at the other end of the grip body which picks up the compression force in the grip body and transfers it to the central shaft. In various embodiments, the shaft may reside within the central aperture of the grip bode as an interference fit or as a clearance fit; alternatively it may be rigidly or rotatably coupled to the grip body.

A grip body made of a compliant material such as an elastomer with a Shore A durometer between 35 A and 85 A may also deform so as to offer substantial support to individual fingers of a gripping hand, which affords superior comfort and effective transfer of the pulling force of the arm (as opposed to its gripping force,) into the grip body. An alternative embodiment of the grip body may use harder plastic or rubber materials in the range of Shore 30 D to 80 D.

A grip body in accordance with the invention has three progressively larger adjoined oblate spheroids [S1, S2, S3] with their polar axes collinear with a central axis, and their centroids spaced along the central axis. The spacing between spheroids [S1] and [S2] is a dimension 'a1' and the spacing between spheroids [S2] and [S3] is a dimension 'a2.' The major and minor diameters of spheroid [S1] are denoted 'D1' and 'd1' respectively in this specification, so that spheroids [S2] and [S3] have major and minor diameters 'D2' and 'd2,' and 'D3' and 'd3' respectively.

The ideal number of spheroids is three because of the three spaces which defined between four grasping fingers. The spheroids are arranged in progressively larger major diameters because these fit best within the combined shape of the interior surfaces of the grasping surface acting opposite to the concave shape of the interior surface of the palm of the gripping hand. The diameter of the third spheroid S3 must be large enough to take in the pulling force of the third finger so that this pulling force does not crush or discomfort the little finger, although when used in an inverted position the largest spheroid [S3] is in contact with the thumb and first finger and not in contact with the little finger.

The invention fits a user's hand and palm better than other devices because (a) it has no bottom flange which would compress the little finger, (b) the progressively larger spheroids of the invention prevent the hand from sliding off the end, (c) largest diameter of the grip body is not located on the end or bottom but instead resides above the bottom, which allows little finger to find its own comfortable gripping diameter.

When the minor diameters of two adjacent adjoined spheroids are sized comparably to or larger than the diameter of a user's larger fingers, then the spheroids may be spaced apart to form an interface with an invected surface therebetween, wherein at least a portion of the invected surface forms an included angle of about 70°, which in this specification shall be defined as 70° plus or minus 10°. This in-folding geometry is particularly effective at deeply admitting the fingers of a gripping hand so that forces developed by an exercising user may be transferred into the grip body without great circular compressive forces (i.e, grip strength) being required.

Figure 3A:
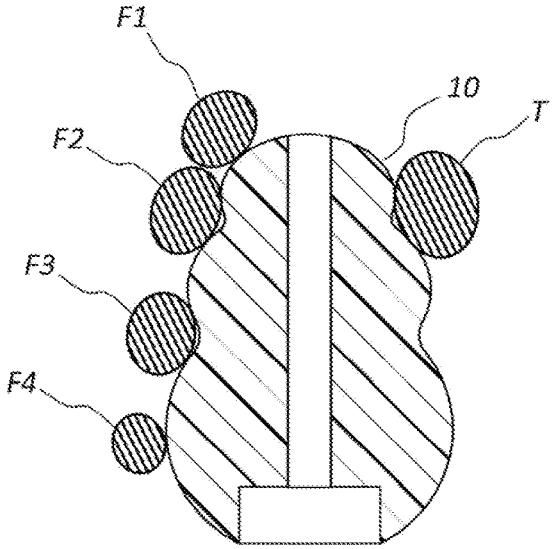
FIGS. 3*a* and 3*b* show cross sections of a thumb and fingers in positions of two common modes of a user gripping the invention.
Figure 3B:
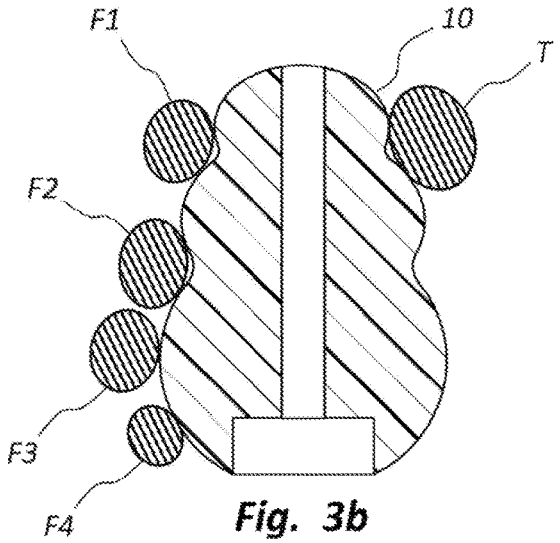

A user has many options for gripping the invention, but two predominant modes are illustrated in FIGS. 3*a* and 3*b*. In these figures and also in FIGS. 3*c* and 3*d*, the thumb, the first, second, and third fingers, and the little finger of a hand are labeled [T,] [F1,] [F2,] [F3,] and [F4] respectively. With the grip body [10] of FIG. 3*a*, the thumb rests in the trough or groove, which is the invected surface between spheroids S1 and S2. Opposite the thumb, the first finger rests above the equator of spheroid S1, the second finger rests in the invected surface between spheroids S1 and S2, the third finger rests in the invected surface between spheroids S2 and S3, and the little finger grasps S3 at or near its equator.

With the grip body [10] of FIG. 3*b*, the thumb rests in the trough or groove which is the invected surface between spheroids S1 and S2. Opposite the thumb, the first finger rests in the invected surface between spheroids S1 and S2 the second finger rests in the invected surface between spheroids S2 and S3, and the third finger grasps S3 at or near its equator, and the little finger cups the underside of S3 in concert with the third finger.

Figure 3C:
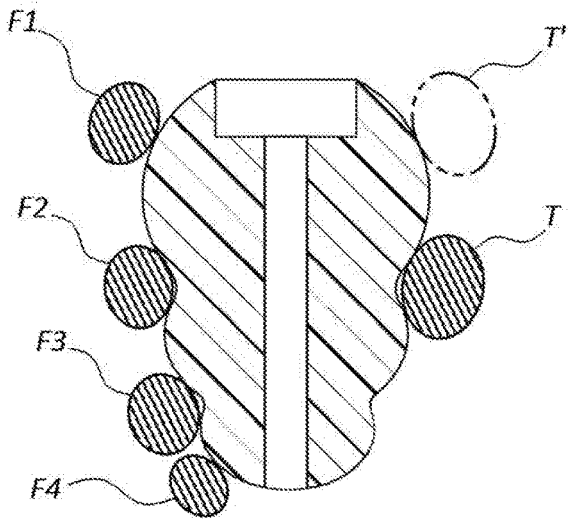
FIGS. 3*c* and 3*d* show cross sections of a thumb and fingers in positions of two common modes of a user gripping the invention in an inverted orientation.
Figure 3D:
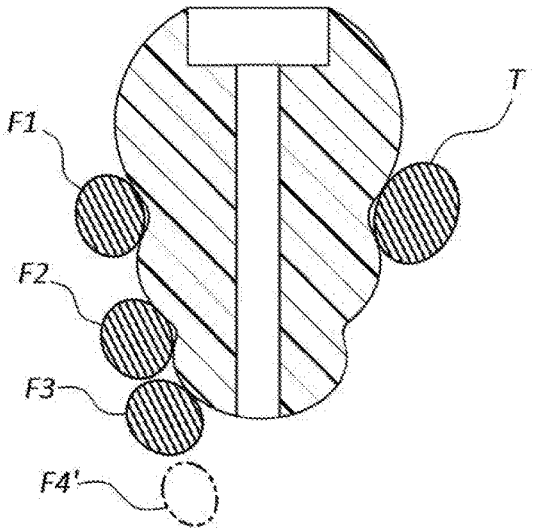

FIGS. 3*c* and 3*d* show cross sections of a thumb and fingers in positions of two common modes of a user gripping the invention in an inverted orientation. Here the spheroids S1, S2, and S3 are reversed top to bottom. In FIG. 3*c*, the first finger rests above the equator of spheroid S3 and the second finger and the thumb both rest in the invected surface between spheroids S2 and S3. When the thumb and a finger reside in the same groove with the grip oriented with larger spheroids above smaller ones, the thumb and finger in the same groove provide a nearly complete ring of support of the spheroid above them, so a substantial amount of exercise force may be transferred into the grip body at that interface even though the region of support is less than a complete circle. This capability of the invention is a major aspect of how it allows a user to exercise larger muscles of the body without requiring the user's hand and grip to develop great crushing strength around the grip body.

The third finger rests in the invected surface between spheroids S1 and S2, and the little finger rests on spheroid S1. The thumb may also rest roughly opposite the first finger, on or above the equator of spheroid S3. In this position the thumb and first finger clamp the grip from above to seat the grip into a concave region of the palm of the hand which is naturally formed when gripping a bulbous object or a ball.

FIG. 3*d* shows another alternate mode of gripping the invention when it is inverted. In this grip mode, which resembles how one holds an ice cream cone, the thumb and first finger both rest in the invected surface between spheroids S2 and S3. As above, when the thumb and a finger reside in the same groove, a nearly complete ring of support of the spheroid above them is established and a substantial amount of exercise force may be transferred into the grip body. The second finger rests in the invected surface between spheroids S1 and S2, and the third finger cups the underside of spheroid S1. The little finger may optionally abut the third finger or may be left extended and not participate in gripping.

Gripping the invention with the attachment affordance or eyelet protruding below the hand allows a user to achieve a neutral grip when raising the forearms against weight from below. When exercising with weights, a palms-up (overhand) grip and a palms-down (underhand) grip are commonly employed on horizontal bars or handles. These hand positions may cause elbow pain because they may strain the muscles on either side of the forearm. In contrast, a neutral grip allows a user's palms to face each other with the thumbs atop the grips. The neutral grip is less likely to cause injuries, especially with novice users who may not be exercising symmetrically, or those who have developed muscle imbalances over the years due to handedness or a previous history of sub-optimal workout regimens.

The inventive grip may help a user gain strength evenly on both sides of the body, which not only makes the body more symmetrical but may also reduce potential injuries. A primary benefit of the invention is by allowing a user to achieve a neutral grip awhile working against pairs of cables oriented in almost any direction, the user has opportunity and freedom to isolate whichever muscle group he or she desires to work on, without developing joint pain. Using the invention, an exercising person may work particular muscles or muscle groups to failure, rather than having to stop short due to joint discomfort or worry of injury.

Figure 4:
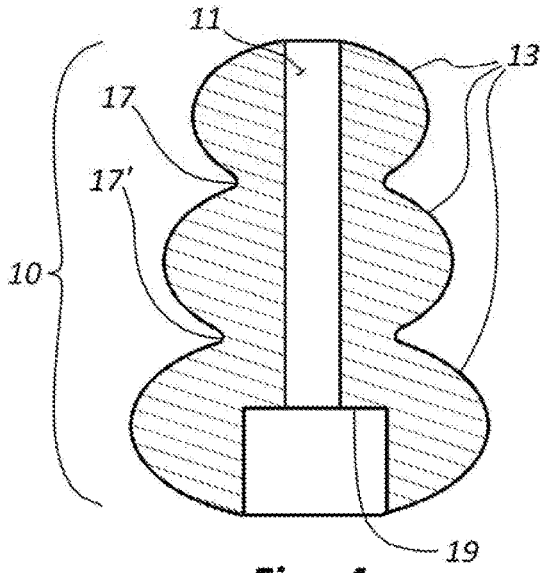
FIG. 4 shows a cross section of grip body in accordance with the invention.

FIG. 4 shows alternative embodiment of a grip body [10] also in accordance with the invention. A grip body [10] is composed of three oblate spheroids [13] adjoined as upper, middle, and lower spheroids, and has an aperture [11] collinear with its central axis. The upper oblate spheroid body has a first major diameter, the middle oblate spheroid body has a second major diameter, and the lower oblate spheroid body has a third major diameter. The second major diameter is greater than the first major diameter but less than the third major diameter.

The interfaces of adjacent spheroids have fillets at their invected surfaces for improved manufacturability and resistance to splitting under tension. The spheroids are spaced apart so that surfaces between the first and second and the second and third spheroids form invected surfaces which are sized to admit fingers of the hand. The lower end of the upper oblate spheroid body abuts an upper end of the middle oblate at an upper invected surface [17,] and the lower end of the middle oblate spheroid body abuts an upper end of the lower oblate spheroid body at a lower invected surface [17'.] FIG. 4 also shows the central aperture having a counterbore cavity [19] of a larger diameter than the rest of the aperture, and a depth.

Figure 5:
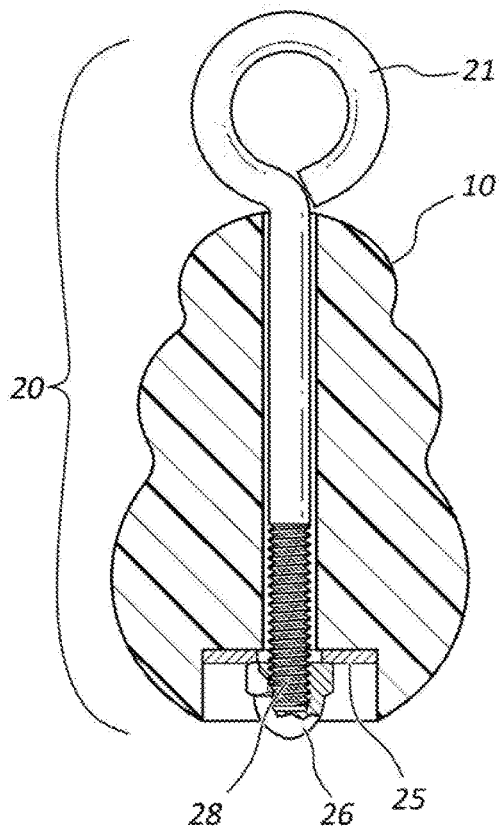
FIG. 5 shows a cross section of an alternative embodiment of a grip assembly in accordance with the invention.

FIG. 5. shows a cross-section of an embodiment of the invention in which the grip assembly [20] has a grip body [10] is composed of three prolate spheroids, spaced apart along a central axis so that a portion of the invected surface between adjacent spheroids forms a tangent cone with an apex angle that is equal to or greater than 70°. The grip body has an aperture extending through the grip body, and a washer [25] is disposed within a counterbore or an internal cavity which is also part of the aperture. The attachment affordance of the shaft [21] in this embodiment is an eye of an eyebolt disposed within the aperture and protruding beyond the grip body. This particular eyebolt is a threaded eyebolt, with threads [28] on the opposite end from the eye, which is formed as a circular ring, and the washer is coupled to the eyebolt by at least one threaded nut [26.] The bottom-most nut may be an acorn nut for functional or decorative effect. The shank or shaft of the eyebolt may be at least partially threaded or its entire length may be threaded. The threaded shaft portion of the eyebolt extends into the non-uniform bore and said circular ring extends beyond the proximal end of the hollow grip body. Although a single jam nut may suffice to assemble an embodiment in accordance with the invention, using two nuts jammed against each other may be a preferable mode for assembly, durability, and ornamentality.

Figure 6:
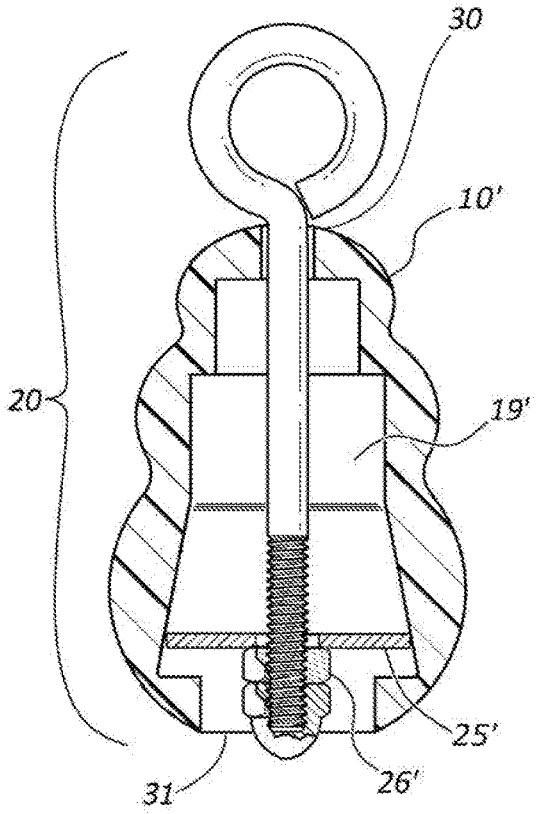
FIG. 6 shows a cross section of another alternative embodiment of a grip assembly in accordance with the invention.

FIG. 6 shows a grip assembly [20] using another alternative for the grip body. This grip body [10'] includes an aperture having an internal cavity [19'] made up of at least one cylindrical portion and a conical portion also called a frustum. The cylindrical cavity defines a linear axis for the grip body. A larger diameter, thin washer [25'] such as a fender washer is fitted onto an eye and double-nutted into place. Double nutting substantially prevents either nut from coming loose on its threads and thus substantially prevents the assembly from coming apart. The nut installed first is a regular hex nut [26'] and it is positioned so as to force the outer perimeter of the washer to engage and press into the conical interior wall in the aperture of the grip body. The hex nut and the reaction force from the compressed material of the grip body substantially immobilize the washer. In use, the axial components of compressing forces absorbed from a gripping hand are transferred into the washer and then to the shaft of the eye. The large central cavity of the grip body allows the spheroids to compliantly conform to the user's fingers and the inner concavities of the palm of the hand for increased comfort and positive grip.

For the above described grips to be effective, the spheroids of a grip body of the invention must be sized to roughly equal or exceed the diameters of users' grasping fingers, and they must be spaced apart so that the invected surfaces or grooves are deep enough to admit enough of a portion of a finger to adequately transfer the pulling force from the finger into the spheroid below the invected surface. Also, the grip body must be strong enough to withstand compressive internal loads over its usage life, while also being compressible enough to distort slightly to conform to the inner contours of the hand, so that a user may establish the best possible grip.

An alternative embodiment within the scope of the invention is an ergonomic strength conditioning grip that self-adjusts to the connection cable for the most efficient line of pulling force. To operate in this manner, the washer is adjusted in its position along the threaded portion of the eyebolt by means of the positions of the nuts [26, 26'] so that the washer simultaneously acts as a compression limiting member for the elastic deformable hollow body which is the grip body and also as a bearing plate so that the eyebolt may swivel within the grip body. Allowing the eyebolt to swivel increases comfort for the user especially where served or braided rope or cable to which the grip is attached includes any torsional preloads or twist which is accumulated and released as the cable is drawn out and taken back up by an exercise machine.

The grip body [10'] is an elastically deformable body having a linear axis defined by any one of its internal cylindrical bores, and a proximal end [30] and a distal end [31.] The sum of the stepped cylindrical bores and the frustum combine to create a cavity [19'] which is a non-uniform bore extending between the proximal end and distal ends, and having a longitudinal axis preferably in common with the linear axis of said hollow body. The exterior surfaces of the grip body include an upper oblate spheroid body, a middle oblate spheroid body, and a lower oblate spheroid body arranged in a vertically stacked configuration.

The eyebolt is inserted so that the eye [21 in FIG. 5] or circular ring portion formed at its end emerges and extends beyond the proximal end of the grip body. The shaft of the eyebolt is collinear with the linear axis of the grip body and extends into the non-uniform bore and is at least partially threaded and may be threaded along its entire length. The eyebolt is rotatable within the grip body, and an axis of rotation of the eye bolt is collinear with the linear axis of the grip body. The axis may adjust itself during elastic deformation of the grip body. At least one nut is threadingly engaged onto the threaded shaft. Two nuts set together with the second one acting as a jam nut are preferred. Where the number of nuts is two, one is an upper nut and the other is a lower jam nut abutting the upper nut, and the upper nut abuts a bottom planar face of the compression limiting member, which is the washer. The washer may be described in detail as being a compression limiting member having two parallel, planar faces and a circular peripheral edge, abs as a compression limiting member the washer is frictionally constrained on the threaded shaft between the nut and a bore wall of the lower oblate spheroid body.

Figure 7:
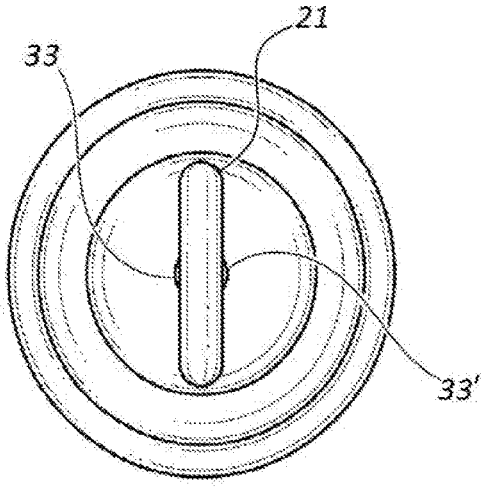
FIG. 7 shows a top view of an embodiment of a grip assembly in accordance with the invention.

FIG. 7 shows a top a top view of an embodiment of a grip assembly in accordance with the invention. To assist the eyebolt in spinning within the grip body, the grip body includes at least one lubrication orifice [30] extending between the proximal end of the grip body and the non-uniform bore which is the inner cavity of the grip body, which may also be called an eye bolt lubrication chamber. Lubricants such as grease or petroleum jelly may be deposited into any of the at least one lubrication orifice extending between the proximal end and the eye bolt lubrication chamber.

According to alternative embodiment within the scope of the invention, the aperture in top of the grip body communicating with the non-uniform bore within forms two lubrication orifices [33, 33'] adjacent to the circular ring [21] at the proximal end, and preferably may be located across from each other on opposite sides of the circular ring. Also, a round through-hole in the grip body may be used so that when the eyebolt ring is drawn inwardly during its adjustment with the washer and nut, compressive forces in the elastomeric grip body immediately beneath the regions of contact between eye ring and the first oblate spheroid also deform the through-hole perpendicularly away from the midplane of the eye ring to produce the two lubrication orifices adjacent to the circular ring and located across from each other on opposite sides of the circular ring.

When a lubricant is deposited within the eye bolt lubrication chamber for assisting or quieting the swivel action of the eyebolt, the washer acts as a seal to the distal end of the bore so that lubricants may be retained within the lubrication chamber of the grip body. Acting as a lubricant seal, the washer may be described as a lubricant seal having an upper planar face parallel with a lower planar face, a circular edge about a periphery of the upper planar face and the lower planar face, and it is frictionally constrained on the threaded shaft between the bore wall and the nut, thus forming a seal along its perimeter.

Washers of different sizes may be used to adjust the compressibility of the hollow body by means of selecting from among washers of various thicknesses, and also by means of locating the washer at a desirable point along the shaft of the eyebolt so that a desired firmness or deformability is obtained at the preference of and for the comfort of the user. Since the location of the lubricant seal along the washer is adjustable, the volume of the interior cavity or lubrication chamber formed in between the upper face of the lubricant seal and the bore wall of the internal cavity in the grip body is also adjustable by volume. The internal cavity is a volume adjustable chamber.

According to another alternative embodiment within the scope of the invention, the washer or compression limiting member, the eyebolt and the one or more nuts may all have oxidation resistant surfaces such as nickel plate, or by some or all of these components being made of brass or bronze alloys or stainless steel. Also, the invention may be furnished to the user with a kit or set of interchangeable washers of a range of diameters and thicknesses, so that as the user's needs change, the user may swap out one washer for another so that the user may adjust the firmness of the body by changing the radial press exerted at the rim of the washer where it contacts the inner cavity of the grip body, and also by controlling the location along the shaft of the eyebolt by setting the position of the one or more nuts on the threaded portion of the eyebolt.

The user may increase the firmness of the compliant grip body by employing the washer as a compression limiting member and longitudinally compressing the grip body between the eyebolt and the compression limiting washer, especially by limiting the compressibility of the third or lower spheroid portion of the grip body. Also, when lubricants are used and the washer thus acts as a lubrication seal, the lubricant seal may be provided as one of a set of washer seals providing one or more interchangeable diameters. The nuts operating on the threaded portion of the eyebolt provide a height adjustment where 'height' is measured in a direction from the distal end to the proximal end of the grip body, so that the lubricant seal, which also acts as a compression washer for adjusting the firmness of the body when gripping it, thus affords that the lubricant seal is both height adjustable and is a compression limiting member.

Selection of an elastomeric or compressible material for the grip body involves evaluating whether the material behaves inertly when a desired lubricant is deposited within the volume adjustable eye bolt lubrication chamber and is constrained by the lubricant seal. Materials for the grip body and the lubricant seal may be selected so they are proof against any sort of solvent action or corrosive properties of the lubricant so that between judicious selection of materials and the degree of press-fit between the rim pf the lubricant seal washer and the bore wall of the cavity, the assembly may be adapted to constrain any lubricant so the eye bolt may rotate freely and self-adjust its connection to the cable to orient itself in use for the most efficient line of pulling force.

In sizing the invention, the inventor has found ranges of effective dimensions for the major and minor diameters and the spacings between their centroids as shown in FIG. 2. The largest and smallest effective embodiments within the scope of the invention are listed in the table following, and a best mode size within the extremes is also listed. The ratio of each spheroid's minor to major diameter, and the ratio of spacings between first and second and second and third spheroid centroids are also computed.

TABLE 1

| Size Ranges for Effective Grip Bodies | | | |
|---|---|---|---|
| Smallest effective size: | | | |
| S1: | D = 1.136 | d = 0.684 | D/d = 0.602 |
| S2: | D = 1.537 | d = 0.860 | D/d = 0.559 |
| S3: | D = 1.940 | d = 1.196 | D/d = 0.616 |
| a1: 0.640 a2: 0.838 a1/a2: 0.764 | | | |
| Best mode size: | | | |
| S1: | D = 1.547 | d = 1.050 | D/d = 0.679 |
| S2: | D = 1.989 | d = 1.153 | D/d = 0.580 |
| S3: | D = 2.259 | d = 1.904 | D/d = 0.842 |
| a1: .766 a2: 0.968 a1/a2: 0.791 | | | |
| Largest effective size: | | | |
| S1: | D = 1.973 | d = 1.240 | D/d = 0.628 |
| S2: | D = 2.508 | d = 1.504 | D/d = 0.600 |
| S3: | D = 2.855 | d = 2.284 | D/d = 0.800 |
| a1: 0.947 a2: 1.227 a1/a2: 0.771 | | | |

Abbreviation Key:
D = major diameter
d = minor diameter
S1 = Spheroid 1
S2 = Spheroid 2
S3 = Spheroid 3
a1 = centroid spacing between S1 and S2
a2 = centroid spacing between S2 and S3

Although the scope of the invention includes invected grooves having included angles of 70° and greater, with good gripping available with a 100° to 135° included angle, larger angles exceeding 150° create shallow grooves which begin to require great grip strength before effective tensions for body conditioning may be developed. In contrast, the included angles formed between adjoined spheroids of predetermined size within the ranges of the table above are related to the effective diameter of a gripping hand in a range able to sustain axial forces in the forearm commensurate with those developed by large muscles of the upper back and the upper torso. However, the design of the groove must also allow easy and complete cleaning of sweat or foreign matter. Although deep, narrow grooves may help convey sweat away from gripping fingers and eliminate slipping problems, if made too deep a groove may collect foreign matter and become unsanitary. The grip body material should thus be waterproof so that sweat or biological matter are not absorbed and retained therein.

A matte surface texture such as Mold-tech 11020, 11030, or similar is preferred, and may be molded in during manufacture of a grip body. These textures require more generous draft angles and preclude deeply invected grooves between the adjoined spheroids of a grip body.

While certain features and aspects have been described with respect to exemplary embodiments, one skilled in the art will recognize that numerous modifications are possible. Also, while certain functionality is ascribed to certain system components, unless the context dictates otherwise, this functionality may be distributed among various other system components in accordance with the several embodiments.

Moreover, while the procedures of the methods and processes described herein are described in a particular order for ease of description, unless the context dictates otherwise, various procedures may be reordered, added, and/or omitted in accordance with various embodiments. Furthermore, the procedures described with respect to one method or process may be incorporated within other described methods or processes; likewise, system components described according to a particular structural configuration and/or with respect to one system may be organized in alternative structural configurations and/or incorporated within other described systems.

Hence, while various embodiments are described with or without certain features for ease of description and to illustrate exemplary aspects of those embodiments, the various components and/or features described herein with respect to a particular embodiment may be substituted, added, and/or subtracted from among other described embodiments, unless the context dictates otherwise. Consequently and in summary, although many exemplary embodiments are described above, it will be appreciated that the invention is intended to cover all modifications and equivalents within the scope of the following claims.

What is claimed is:

1. An ergonomic strength conditioning grip that self-adjusts to a connection cable for the most efficient line of pulling force comprising;

an elastic deformable hollow body having a linear axis, a proximal end, and a distal end, said hollow body having an upper oblate spheroid body, a middle oblate spheroid body and a lower oblate spheroid body arranged in a vertically stacked configuration;

a non-uniform bore extending between said proximal end and said distal end, said bore having a longitudinal axis common with said linear axis of said hollow body;

a rotatable eyebolt having a circular ring formed at an end of an at least partially threaded shaft, said threaded shaft extending into said non-uniform bore and said circular ring extending beyond said proximal end;

at least one nut threadingly engaged on said threaded shaft;

a compression limiting member having two parallel, planar faces and a circular peripheral edge, said compression limiting member frictionally constrained on said threaded shaft between said nut and a bore wall of said lower oblate spheroid body, and at least one lubrication orifice extending between said proximal end and said non-uniform bore.

2. The ergonomic strength conditioning grip of claim 1, wherein said compression limiting member is an interchangeable diameter, height adjustable member adapted to limit the compressibility of said lower oblate spheroid body.

3. The ergonomic strength conditioning grip of claim 1, wherein an axis of rotation of said eyebolt is collinear with said linear axis of said hollow body.

4. The ergonomic strength conditioning grip of claim 1, wherein said eyebolt, said compression limiting member, and said nut all have oxidation resistant surfaces.

5. The ergonomic strength conditioning grip of claim 1, wherein a lower end of said upper oblate spheroid body abuts an upper end of said a middle oblate at an upper invected surface, and a lower end of said middle oblate spheroid body abuts an upper end of said lower oblate spheroid body at a lower invected surface.

6. The ergonomic strength conditioning grip of claim 5, wherein said upper oblate spheroid body has a first major diameter, said middle oblate spheroid body has a second major diameter and said lower oblate spheroid body has a third major diameter, and wherein said second major diameter is greater than said first major diameter but less than said third major diameter.

7. The ergonomic strength conditioning grip of claim 1, where the number of nuts is two, one of an upper nut and one of a lower jam nut abutting said upper nut, wherein said upper nut abuts a bottom planar face of said compression limiting member.

8. The ergonomic strength conditioning grip of claim 1, where the number of said lubrication orifices is two, and said lubrication orifices are adjacent said circular ring at said proximal end and are located across from each other on opposite sides of the circular ring.

9. An ergonomic strength conditioning grip that self-adjusts to a connection cable for the most efficient line of pulling force comprising;

an elastic deformable hollow body having a linear axis, a proximal end, and a distal end, said body having an upper oblate spheroid body, a middle oblate spheroid body, and a lower oblate spheroid body arranged in a vertically stacked configuration;

a non-uniform bore extending between said proximal end and said distal end, said bore having a longitudinal axis common with said linear axis of said hollow body, and a bore wall;

a rotatable eyebolt having a circular ring formed at an end of an at least partially threaded shaft, said threaded shaft extending into said non-uniform bore and said circular ring extending beyond said proximal end;

at least one nut threadingly engaged on said threaded shaft;

a lubricant seal having an upper planar face parallel with a lower planar face, and a circular edge about a periphery of said upper planar face and said lower planar face, said lubricant seal frictionally constrained on said threaded shaft between said bore wall and said nut;

a volume adjustable, eyebolt lubrication chamber formed in said body between said upper face of said lubricant seal and said bore wall; and at least one lubrication orifice extending between said proximal end and said eyebolt lubrication chamber.

10. The ergonomic strength conditioning grip of claim 9, wherein said lubricant seal is an interchangeable diameter, height adjustable lubricant seal adapted to constrain a lubricant deposited within said volume adjustable, eyebolt lubrication chamber so said eyebolt can rotate freely and self-adjust to said connection cable for the most efficient line of pulling force.

11. The ergonomic strength conditioning grip of claim 9, wherein an axis of rotation of said eyebolt is collinear with said linear axis of said elastic deformable body.

12. The ergonomic strength conditioning grip of claim 9, wherein said eyebolt, said lubrication seal, and said nut all have oxidation resistant surfaces.

13. The ergonomic strength conditioning grip of claim 9, wherein a lower end of said upper oblate spheroid body abuts an upper end of said a middle oblate at an upper invected surface, and a lower end of said middle oblate spheroid body abuts an upper end of said lower oblate spheroid body at a lower invected surface.

14. The ergonomic strength conditioning grip of claim 13, wherein said upper oblate spheroid body has a first major diameter, said middle oblate spheroid body has a second major diameter and said lower oblate spheroid body has a third major diameter, and wherein said second major diameter is greater than said first major diameter but less than said third major diameter.

15. The ergonomic strength conditioning grip of claim 9, where the number of nuts is two, one of an upper nut and one of a lower jam nut abutting said upper nut, wherein said upper nut abuts said bottom planar face of said lubricant seal.

16. The ergonomic strength conditioning grip of claim 9, where the number of said lubrication orifices is two and said lubrication orifices are adjacent said circular ring at said proximal end and are located across from each other on opposite sides of said circular ring.

* * * * *